US011199354B2

(12) United States Patent
Geitz et al.

(10) Patent No.: US 11,199,354 B2
(45) Date of Patent: Dec. 14, 2021

(54) REFRIGERATION UNIT HAVING AN ACCUMULATOR, REFRIGERATION SYSTEM AND METHOD FOR CONTROLLING A REFRIGERATION UNIT HAVING AN ACCUMULATOR

(71) Applicant: VIESSMANN WERKE GMBH & CO. KG, Allendorf (DE)

(72) Inventors: Benedikt Geitz, Battenberg (DE); Gerd Odendahl, Gelsenkirchen (DE); Manfred Vaupel, Frankenberg (DE)

(73) Assignee: VIESSMANN WERKE GMBH & CO. KG

( * ) Notice: Subject to any disclaimer, the term of this patent is extended or adjusted under 35 U.S.C. 154(b) by 127 days.

(21) Appl. No.: 16/610,796

(22) PCT Filed: Mar. 14, 2018

(86) PCT No.: PCT/EP2018/056335
§ 371 (c)(1),
(2) Date: Nov. 4, 2019

(87) PCT Pub. No.: WO2018/202347
PCT Pub. Date: Nov. 8, 2018

(65) Prior Publication Data

US 2020/0072524 A1 Mar. 5, 2020

(30) Foreign Application Priority Data

May 2, 2017 (DE) ..... 10 2017 109 357.5

(51) Int. Cl.
*F25D 11/00* (2006.01)
*A47F 3/04* (2006.01)
(Continued)

(52) U.S. Cl.
CPC ..... *F25D 11/006* (2013.01); *A47F 3/04* (2013.01); *F25D 16/00* (2013.01); *F25D 17/02* (2013.01);
(Continued)

(58) Field of Classification Search
CPC ..... F25D 11/006; F25D 17/02; F25D 16/00; A47F 3/04
See application file for complete search history.

(56) References Cited

U.S. PATENT DOCUMENTS 5,678,626 A * 10/1997 Gilles ..... F25D 16/00 165/62
7,735,461 B2 * 6/2010 Vetrovec ..... F28D 20/021 123/41.14
(Continued)

FOREIGN PATENT DOCUMENTS

DE 102010041951 4/2012 ..... F25D 11/00
DE 102011104140 12/2012 ..... F25B 27/00
(Continued)

OTHER PUBLICATIONS

International Search Report and Written Opinion (w/translations) issued in application No. PCT/EP2018/056335, dated Jul. 19, 2018 (19 pgs).
(Continued)

*Primary Examiner* — Ana M Vazquez
(74) *Attorney, Agent, or Firm* — Hayes Soloway P.C.

(57) ABSTRACT

Disclosed is a refrigeration unit having an accumulator, a refrigeration system and a method for controlling a refrigeration unit having an accumulator, wherein the refrigeration unit has a refrigeration chamber for receiving and storing goods to be refrigerated, an accumulator having an accumulator holder in which a storage medium is accommodated, a heat exchanger, a controller and a coolant line
(Continued)

arrangement which can be connected to a coolant supply network via connections. The coolant line arrangement is guided through the accumulator holder, and the heat exchanger is thermally coupled to the storage medium accommodated in the accumulator holder. A coolant control device is arranged in the flow pipe of the coolant arrangement, wherein the storage medium accommodated in the accumulator holder is cooled via a coolant in the coolant line arrangement, and the heat exchanger is cooled via the storage medium.

10 Claims, 5 Drawing Sheets

(51) Int. Cl.

| | |
|---|---|
| ***F25D 16/00*** | (2006.01) |
| ***F25D 17/02*** | (2006.01) |
| ***F25D 17/06*** | (2006.01) |
| ***F25D 25/02*** | (2006.01) |
| ***F25D 29/00*** | (2006.01) |

(52) U.S. Cl.
CPC ..... *F25D 17/06* (2013.01); *F25D 25/02* (2013.01); *F25D 29/00* (2013.01); *F25B 2400/22* (2013.01); *F25B 2600/13* (2013.01); *F25D 2317/068* (2013.01)

(56) References Cited

U.S. PATENT DOCUMENTS

| | | | | |
|---|---|---|---|---|
| 9,366,483 | B2 * | 6/2016 | Eckhoff | F25D 29/005 |
| 2006/0048520 | A1 * | 3/2006 | Huang | F25B 21/04 62/3.5 |
| 2011/0259041 | A1 * | 10/2011 | Kuehl | F25D 23/003 62/507 |
| 2015/0143818 | A1 | 5/2015 | Eckhoff et al. | F25D 11/00 |

FOREIGN PATENT DOCUMENTS

| | | | |
|---|---|---|---|
| DE | 102012207682 | 11/2013 | F25D 19/00 |
| EP | 2009373 | 12/2008 | F25D 17/02 |
| EP | 3076109 | 10/2016 | F25D 17/02 |
| JP | 2015218917 | 12/2015 | F25D 11/00 |

OTHER PUBLICATIONS

International Premliminary Report on Patentability issued in application No. PCT/EP2018/056335, dated Nov. 5, 2018 (9 pgs).

* cited by examiner

REFRIGERATION UNIT HAVING AN ACCUMULATOR, REFRIGERATION SYSTEM AND METHOD FOR CONTROLLING A REFRIGERATION UNIT HAVING AN ACCUMULATOR

BACKGROUND OF THE INVENTION

A refrigeration unit with a storage device, a refrigerating system with at least one refrigeration unit and cold generator, and a method of controlling a refrigeration unit with a storage device are described. The refrigeration unit has a refrigerating space for reception and storage of items to be refrigerated. Such refrigeration units can be configured as, for example, refrigerated shelves and are used in retail to present chilled items. The products in the refrigerated shelves are cooled by way of an integrated refrigerating system and can be removed therefrom via a side open at least in a section. A number of refrigerated shelves is usually a component of a refrigerating system which in addition comprises a cold generator.

It is already known from the prior art to provide so-called ice storage devices for a refrigerating system or a refrigerating plant, wherein a cooling liquid for the refrigeration unit can be cooled by way of the ice storage device when, for example, specific operating states are achieved. The operating states comprise, for example, a completely charged ice storage device and the operating costs for refrigerated shelving. For example, in the case of a supermarket an ice storage device can be provided in the ground and is at night—when there are low operating costs (for example for power)—frozen through heat being extracted from the water. After the ice storage device has been completely discharged the coolant circulating in the refrigerating system can be conducted through the ice storage device instead of being cooled by a cold generator, so that the refrigerated shelves connected with the refrigerating system are cooled by way of the ice storage device.

It is not always possible to provide an ice storage device in a refrigerating system, since, for example, local conditions do not allow this. Ice storage devices for a refrigerating system, for example for that of a supermarket, are designed so that the entire refrigerating system can be operated at a certain time with a fully charged ice storage device. The ice storage device is correspondingly dimensioned and occupies a considerable amount of space in the ground. However, smaller ice storage devices arranged, for example, above ground have disadvantages. Firstly, it has to be ensured that sufficient space for such an ice storage device is present, which equally applies when there is a basic lack of space for an ice storage device in the ground. Secondly, an above-ground storage device lacks natural insulation such as, for example, the ground. Consequently, a more pronounced discharge of the ice storage device takes place and the environment of the ice storage device is excessively cooled. Appropriate insulation for an above-ground ice storage device requires additional installation space and creates additional costs.

A central ice storage device of a refrigerating system additionally makes it possible to cool the entirety of the coolant circulating in a supply mains. Accordingly, for a refrigerating system with several refrigeration units it is therefore difficult to satisfy different load demands without excessive discharge of the ice storage device taking place.

For example, DE 10 2011 104 140 A1 describes refrigerating devices for foodstuffs, in which the refrigerating devices are provided with devices cooled by ice water in an ice storage device.

Moreover, refrigerators with a storage device, which provide extension of the intervals between cooling cycles, are known from the prior art.

JP 2015-218 917 A discloses a refrigerated roller container in which ducts serving for cooling run in the walls of the roller container. For that purpose, the ducts bear against heat storage plates. Metal walls which surround the interior space of the roller container are in turn arranged at the heat storage plates.

DE 10 2010 041 951 A1 discloses a refrigerating appliance with a coldness store in which a heat exchanger is connected by way of a separate line arrangement with the coldness store.

EP 2 009 373 A2 discloses a refrigerating plant with additional refrigerating devices.

SUMMARY OF THE INVENTION

Accordingly, the object is to indicate a refrigeration unit with a storage device, a refrigerating system, and a method of controlling a refrigeration unit with a storage device, wherein it is possible to dispense with an external ice storage device and a more modular connection with already existing refrigerating systems and more autonomous operation of the refrigeration unit are possible. In addition, the components of the refrigeration unit are to be protected from damage such as, for example, icing and the refrigeration unit is to have a simple construction. A further object is to indicate a refrigeration unit having reduced energy consumption compared with refrigeration units of the prior art.

In a refrigeration unit fulfilling the aforesaid object and comprising at least a refrigerating space for reception and storage of items to be refrigerated, a storage device with a storage device container in which a storage medium is received, a heat exchanger, a controller and a coolant line arrangement connectible by way of connections with a coolant supply network,

- the coolant line arrangement is led through the storage device container,
- the heat exchanger is thermally coupled with the storage medium received in the storage device container,
- a coolant regulating device is arranged in the forward run of the coolant line arrangement,
- the coolant regulating device is a speed-regulated pump,
- the storage device container at least in a section consists of a thermally conductive material and has an insulation,
- the insulation completely surrounds the storage device apart from a section by way of which the storage device is connected with the heat exchanger and
- the heat exchanger has cooling ribs.

In the case of the refrigeration unit, cooling of the heat exchanger for cooling the refrigerating space is not achieved directly by way of the coolant provided in the coolant line arrangement from a coolant supply network. As a result, the coolant can be decoupled from the coolant supply network. The required 'coldness' for the heat exchanger is derived only from the storage device. Depending on the state of charge of the storage device and the dimensioning of the storage device in relation to the refrigeration unit and the refrigerating space, operation of the refrigeration unit over a longer period of time can therefore be provided without a supply of coldness having to be provided by way of the coolant supply network. Charging of the storage device is carried out by way of the coolant regulating device. The coolant regulating device regulates the feed of coolant from the coolant supply network to the storage device. By way of example, water can be used as storage medium. In addition, additives can be admixed to the water, or phase change elements, which are surrounded by the storage medium, can be accommodated within the storage device. The sections of the coolant line arrangement led through the storage device container can be constructed in such a way that they occupy a relatively large area. These line sections of the coolant line arrangement are arranged in the storage device container in, for example, helical or meandering form. The sections of the coolant line arrangement are preferably so arranged in the storage device container that a defined cooling of the storage medium takes place in direction from the inside to the outside. The controller of the refrigeration unit regulates the coolant feed by way of the coolant regulating device, which is, for example, operated in such a way that in a normal operating cycle of the storage device substantially only between 70% and 90% is frozen or discharged, for example a phase conversion takes place and the storage medium freezes. The normal operating cycle can, for example, include a time period in which the refrigeration unit which as refrigerated shelving in a supermarket is part of a refrigerating system has an increased need for refrigeration. The increased need for refrigeration results from removal of refrigerated items and storage of items to be refrigerated as well as increased heat exchange between the refrigeration unit and the room in which the refrigeration unit is arranged, since in a case of refrigerated shelves usually one side is open in the normal operating cycle. Refrigeration units, for example refrigerated shelves, are closed at night so that a lesser degree of heat exchange between the room in which the refrigeration unit is arranged and the interior of the refrigeration unit or the refrigerating space prevails. However, in further control procedures for the refrigeration unit, operating states can also be present during the day, i.e. at business times of a supermarket, in which case the storage device is fully charged, so that at night—when the need for coldness is reduced in any case due to closing of the refrigerating space of the refrigeration unit—the requirement for coldness is provided solely by the storage device. The power consumption of the refrigeration unit in that case is then dimensioned only by the components of the refrigeration unit for cooling, such as, for example, a fan, the controller and a conveying device.

The refrigeration unit can thus be operated autonomously by way of the storage device. As a result, compensation can also be provided for disruptions in and failures of the refrigerating system or a cold generating device. The refrigeration unit thus ensures safe storage of refrigerated items over a lengthy period of time. In particular, the refrigeration unit is also not reliant on a central conveying device (for example, pump) of the coolant supply network. The refrigeration unit can, in addition, be integrated in an existing refrigerating system, since the internal controller of the refrigeration unit acts independently of the refrigerating system and is connected with the coolant supply network merely by way of connections.

A further advantage of the refrigeration unit described herein is that it is possible to dispense with special thawing of the heat exchanger as known in refrigeration units of the prior art. De-icing of the heat exchanger is achieved by 'thawing' in such a way that coolant for cooling the storage device is no longer supplied and the required 'coldness' is therefore removed from the storage device. As a result, heating of the storage device and the heat exchanger can take place, whereby thawing also occurs. The provision of 'coldness' by way of the heat exchanger is removed from the storage device. In conventional refrigeration units cooling is undertaken directly by way of the coolant conveyed in the refrigerating system, in which case an excessively cooled coolant due to a high requirement for coolant causes excessive cooling down of the heat exchanger. However, the refrigeration unit of the technical teaching described herein can be cooled substantially at a constant temperature. In particular, an essentially defined and barely fluctuating cooling temperature can be provided with the heat exchanger.

The coolant regulating device is a speed-regulated pump. Feed of coolant from the coolant supply network can be steplessly set by way of the pump, in which case rapid cooling or discharge of the storage device can also take place due to a high throughflow rate.

The storage device container can consist of different materials and has an insulation. The insulation prevents absorption of heat from components of the refrigeration unit within the refrigeration unit. In the case of the heat exchanger directly coupled thereto, the insulation surrounds the storage device container apart from the section of the storage device container by way of which the heat exchanger is coupled with the storage device container.

The refrigeration unit can comprise a second coolant line arrangement led through the storage device container and connected with the heat exchanger. The second coolant line arrangement is not directly connected with the coolant supply network, but provides an internal, separate coolant circuit. The coolant in the second coolant line arrangement is cooled by way of the storage device container, in which case the sections of the second coolant line arrangement led through the storage device container can similarly run in meandering or helical form. The second coolant line arrangement is, in particular, so arranged within the storage device container that a defined discharge and thawing, i.e. thermal transfer, for example phase change from solid to liquid (for example thawing of the frozen storage medium), take place in direction from outside to inside. In order to prevent excessive influence of a coolant from the coolant supply network, which is fed by way of the coolant line arrangement to the storage device, with the coolant in the second coolant One arrangement the Ones of the second coolant One arrangement are spaced from the Ones of the coolant One arrangement connected with the coolant supply network.

A speed-regulated pump can be arranged in the forward run of the second coolant line arrangement. The pump in the forward run of the second coolant One arrangement regulates the feed of coolant from the second coolant One arrangement to the heat exchanger, in which case the heated coolant delivers the heat back to the storage device. Autonomous operation of the coolant is thereby similarly ensured, in which case the required quantity of coolant in the second coolant One arrangement is supplied to the heat exchanger in dependence on the refrigeration requirement. In order to detect a refrigeration requirement, the controller of the refrigeration unit is connected with further devices and sensors which, for example, comprise temperature detection devices. The temperature detection devices detect not only the temperature in the refrigerating space at various positions, but also the temperature of the coolant in the second coolant One arrangement. In addition, temperature detection devices can be arranged in the storage device, by way of which devices it is possible to determine the charge state of the storage device.

Temperature detection devices can be provided in all variants described herein. In the alternative, the temperature of a storage device can also be determined by way of the temperature of coolants, for which purpose temperature detection devices are provided in the corresponding forward runs and return runs.

In further forms of embodiment the heat exchanger can be coupled by way of at least one thermally conductive section of the storage device container with the storage medium received in the storage device container. Different variants of embodiment in that case arise. In one embodiment, a storage device is provided which is cooled or discharged by way of a coolant line arrangement connected with a coolant supply network. The storage device is directly connected with a heat exchanger. The heat exchanger consists of, for example, a thermally conductive metal and is connected with a thermally conductive section of the storage device.

The storage device is discharged by way of the coolant supply network. Thawing of the storage device takes place by way of the heat exchanger directly coupled therewith. As a result, it is also possible to prevent icing of the heat exchanger, since a substantially constant temperature prevails due to the thermal couple between heat exchanger and storage device housing.

The refrigeration unit can comprise at least one speed-regulated fan serving for circulation of air within the refrigerating space. Depending on the control of the rotational speed of the fan by way of the controller of the refrigeration unit it is possible to achieve more rapid cooling of refrigerated items or of the refrigerating space, since the circulated air is less strongly heated and thus has a greater capacity for heat absorption. A speed-regulated fan can therefore equally provide defined cooling of the refrigerating space in the case of a refrigeration unit with a storage device and a heat exchanger, which is directly coupled therewith, without a second coolant line arrangement. The heat exchanger then has cooling ribs providing a relatively large heat exchange area.

In further embodiments the refrigeration unit can also be configured as refrigerated shelving. Refrigerated shelves usually have a side which can be opened so as to make the refrigerating space accessible from outside. A device for closing the refrigerated shelving can be formed by, for example, a roller blind. In the open state of the roller blind cold air is circulated in the upper and lower regions of the refrigerated shelving by way of openings, in which case circulation takes place from above to below.

The afore-mentioned object is also fulfilled by a refrigerating system comprising at least one refrigeration unit of the afore-described variants and a cold generator, wherein a coolant is fed by way of a central coolant line arrangement the at least one refrigeration unit via a forward run and conducted away via a return run and the cold generator brings the coolant to a settable temperature, wherein

- the feed of coolant for discharge of the storage device is regulated by way of the controller of the refrigeration unit via the coolant regulating device in the forward run of the coolant line arrangement and/or
- the circulation of air over at least one heat exchanger for cooling the refrigerating space is regulated by way of the controller of the refrigeration unit via the at least one fan and/or
- the feed of coolant to at least one heat exchanger is regulated by way of the controller of the refrigeration unit in dependence on the charge state of the storage device and/or the operating state of the cold generator via the speed-regulated pump in the forward run of the second coolant line arrangement.

The cold generator can be, for example, a heat pump which brings a coolant to a specific temperature. Various coolants known from the prior art can be used as the coolant. For example, a brine (water/glycol mixture) is used. Feed to the individual refrigeration units is undertaken by way of the respective coolant regulating devices thereof. In order to achieve rapid discharge of the respective storage devices of the refrigeration units the coolant can be brought to a very low temperature by way of the cold generator. However, since the coolant from the cold generator is not in direct contact with the heat exchangers of the refrigeration units direct icing of the heat exchangers by the coolant is prevented. In addition, individual refrigeration units can also be controlled autonomously and in a decoupled state from the cold generator are also in a position of ensuring a need-dependent cooling of the refrigerating space over a longer period of time.

The aforesaid object is also fulfilled by a method of controlling a refrigeration unit of the technical teaching described herein, the unit at least comprising a refrigerating space for reception and storage of items to be refrigerated, a storage device with a storage device container in which a storage medium is received, a heat exchanger, a controller and a coolant line arrangement which is connectible with a coolant supply mains by way of connections, wherein the coolant line arrangement is led through the storage device container, the heat exchanger is thermally coupled with the storage medium received in the storage device container and a coolant regulating device is arranged in the forward run of the coolant line arrangement and wherein

- the storage medium received in the storage device container is cooled by way of a coolant in the coolant line arrangement and
- the heat exchanger is cooled by way of the storage medium.

In a development of the method, in which a second coolant line arrangement is led through the storage device container and connected with the heat exchanger and a speed-regulated pump is arranged in the forward run of the second coolant line arrangement,

- discharge of the storage device is carried out by way of the coolant regulating device in the forward run of the first coolant line arrangement and/or
- thawing of the storage device and feed of coolant to at least one heat exchanger are carried out by way of the speed-regulated pump in the forward run of the second coolant line arrangement and/or
- circulation of air for cooling the refrigerating space is carried out by way of at least one speed-regulated fan.

With regard to the afore-described advantages and possibilities of embodiment reference is also made in that respect to the refrigerating system and the method.

Further advantages, features and possibilities of embodiment are evident from the following figure-based description of embodiments, which are not to be understood as having limiting effect.

BRIEF DESCRIPTION OF THE DRAWINGS

In the drawings.

In the drawings, parts provided with the same reference numerals substantially correspond with one another insofar as nothing to the contrary is indicated. In addition, description of components not essential to understanding the technical teaching disclosed herein has been dispensed with.

DETAILED DESCRIPTION OF THE INVENTION

Figure 1:
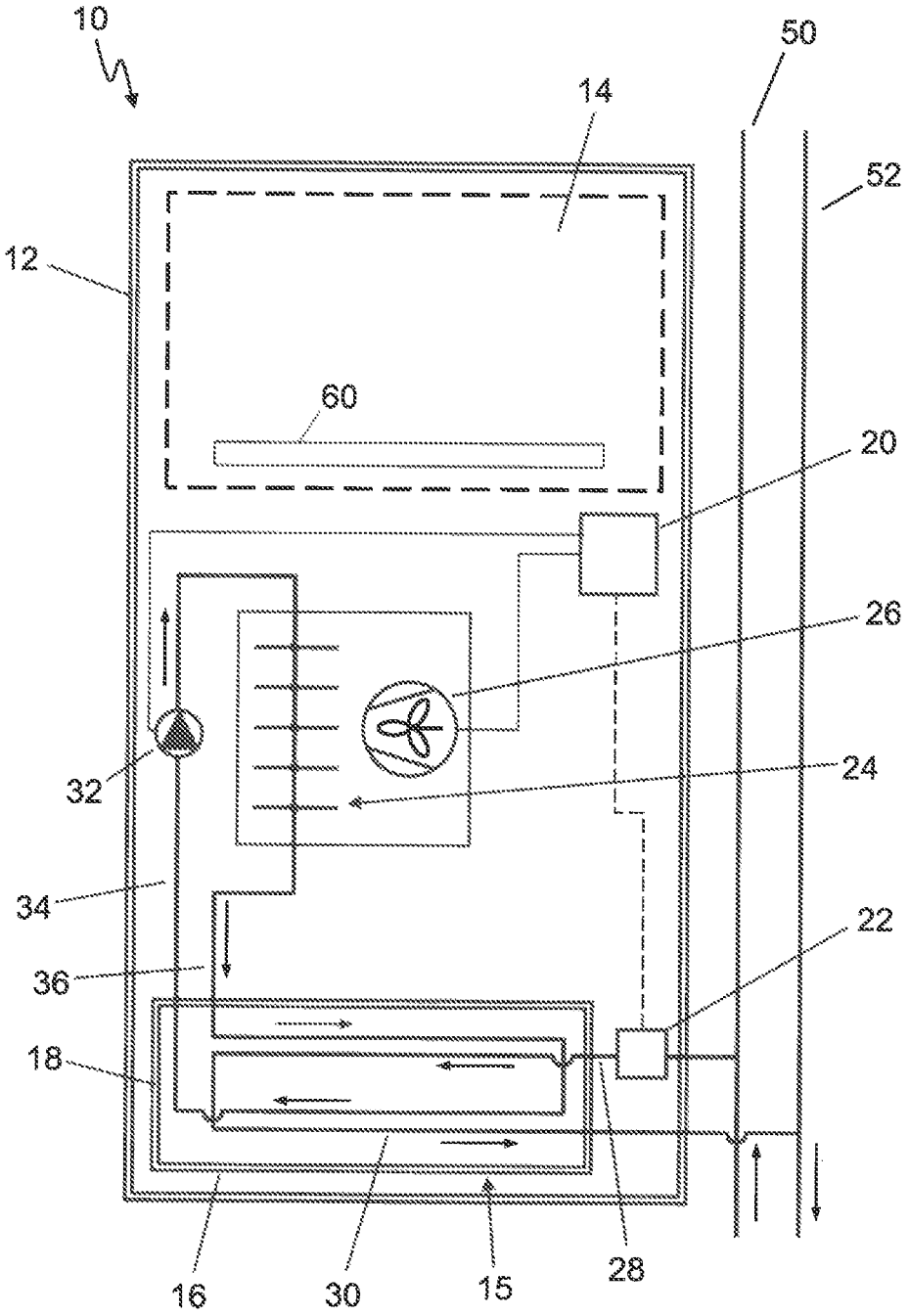
FIG. 1 snows a schematic illustration of a refrigeration unit.

FIG. 1 shows a schematic illustration of a refrigeration unit 10. The refrigeration unit 10 can be constructed as, for example, refrigerated shelving 60 and be part of a refrigerating system with a plurality of refrigeration units 10. A cold generating device, for example a heat pump, is provided in the refrigerating system and cools a coolant conducted in a coolant supply network. The coolant supply network has a forward run 50 and a return run 52. Cooled coolant is fed to the refrigeration units 10 by way of the forward run 50. The coolant heated and returned by the refrigeration units 10 is fed back by way of the return run 52 to the cold generator, which brings the coolant to a specific temperature.

The refrigeration unit 10 comprises a housing 12. The housing 12 encloses the equipment items of the refrigeration unit 10 and a refrigerating space 14. A closure device which can free and close the schematically indicated refrigerating space 14 can be arranged in the housing 12. Such a device is, for example, known as a roller blind in the case of refrigerated shelves.

The refrigeration unit 10 comprises a storage device 15 into which a first line arrangement is led. The first line arrangement is connected by way of the forward run 28 thereof with the forward run 50 of the coolant supply network. The coolant line arrangement is led out of the storage device 15 and the refrigeration unit 10 by way of the return run 30 and is connected with the return run 52 of the coolant supply network. A coolant regulating device 22 is arranged in the forward run 28. The coolant regulating device 22 can be configured as, for example, a valve or as a speed-regulated pump 38 (see FIG. 2). The coolant regulating device 22 and the speed-regulated pump 38 therefore regulate the feed of coolant from the coolant supply network to the storage device 15.

The storage device 15 comprises a housing 16. The housing 16 is surrounded by an insulation 18 which substantially thermally insulates the storage device 15 from the space surrounding it within the refrigeration unit 10. A cooling medium is received in the storage device 15. The cooling medium can be provided by, for example, water. When coolant is fed by way of the coolant supply network via the forward run 28 the cooling medium in the storage device 15 is cooled. A phase conversion, for example, takes place, so that the storage medium transfers from a liquid phase to a solid phase.

In addition, a part of a second coolant line arrangement is led into the storage device 15. The second coolant line arrangement is additionally coupled with a heat exchanger 24, a speed regulated pump 32 being provided in the forward run 34 of the second coolant line arrangement. A coolant is circulated in the separate coolant circuit of the second coolant line arrangement by way of the pump 32. The coolant in the second coolant circuit is cooled by way of the storage device 15 and fed by way of the pump 32 to the heat exchanger 24. Air is fed across the heat exchanger 24 by way of a fan 26, which is similarly speed-regulated, so that cooling of the air takes place. The cooled air is conducted in the product compartment or refrigerating space 14 and/or circulated in the product compartment or refrigerating space 14.

A controller 20 regulates the coolant regulating device 22, the pump 32 and the fan 36. In addition, the controller 20 can take over still further tasks. For example, the controller 20 is coupled with the temperature detection devices which detect the temperature in the refrigerating space 14, in the forward run 34 and return run 36 of the second coolant line arrangement and in the forward run 28 and return run 30 of the first coolant line arrangement. Further, the temperature in the storage device 15 can be detected at various places by way of temperature detection devices. A refrigeration requirement for products in the refrigerating space 14 can be determined by the controller 20 through the temperature detection devices. The controller 20 regulates the pump 32 as a function of the determined refrigeration requirement, so that a greater quantity of coolant can be fed to the heat exchanger 24. In the case of an additional increase in the rotational speed of the fan 26 a greater air flow is circulated, in which case the circulated air is not heated so strongly, which additionally serves for rapid cooling. The cooling of the coolant in the second coolant circuit takes place by way of the storage medium received in the storage device 15. When coolant is fed from the coolant supply network, cooling of the storage medium in the storage device 15 takes place substantially from the inside to the outside. In that case, a phase conversion of the storage medium may occur. For that purpose, the line sections of the first coolant line arrangement or the forward run 26 and return run 30 are laid appropriately in the storage device 15 or in the housing 16. The line sections of the second coolant line arrangement, particularly the line sections of the forward run 34 and the return run 36, extending within the housing 16 of the storage device 16 are so arranged that coding of the coolant conducted therein takes place in such a way that thawing of the storage device 15 or a phase conversion of the storage medium from solid to liquid takes place from the outside to the inside. In addition, the latent heat of the storage medium can be used for discharging and charging the storage device 15 even without a phase conversion.

In operation of the refrigeration unit 10 discharge of the storage device 15 takes place in dependence on the feed of coolant by way of the coolant supply line in the forward run 50 via the coolant regulating device 22 or the pump 38. If the storage device is completely discharged, the feed of coolant by way of the forward run 50 into the storage device 15 can be prevented by way of the coolant regulating device 22 or the pump 38. Cooling of the refrigerating space 14 is regulated by way of the pump 32, for which purpose the amount of coolant in the second coolant circuit with the second coolant line arrangement to the heat exchanger 24 is regulated. If the refrigerating space 14 or the products stored therein has or have an increased need for refrigeration and the controller ascertains rapid thawing of the storage device 15 then the coolant regulating device 22 can provide the feed of coolant from the forward run 50 and regulate the quantity of coolant.

A pump 38, in particular, enables stepless setting of the conveyed quantity of coolant. In addition, the fan 26 determines the amount of circulated air, in which case at higher flow rates of the air this is less strongly heated than in the case of smaller air flows.

If the storage device 15 is discharged to a certain extent and/or the coolant feed via the forward run 50 of the coolant supply network is no longer provided an autonomous operation of the refrigeration unit 10 can also take place. The storage device 15 in that case serves as a cold generator and provides cooling of the coolant conducted in the second coolant circuit. The design of the storage device 15 with respect to the dimensioning of the refrigerating space 14 and the maximum items able to be accepted in the refrigerating space 14 can be as desired. The larger the storage device 15 in relation to the refrigerating space 14 and the products stored therein the faster and/or longer can cooling of the items or the refrigerating space 14 take place. A refrigeration unit 10, which is configured as refrigerated shelving 60, with a roller blind can, preferably be operated at night solely by the 'coldness' provided by way of the storage device 15, in which case the coolant supply network does not have to be placed in operation for that purpose. In the case of heat pumps as cold generator, this has the advantage that the cycles of the heat pumps, i.e. the intervals between switching on and switching off, are extended, In addition, in the case of a refrigerating system with a plurality of refrigeration units 10 an emergency cooling can be provided in the event of failure of the cold generator. The refrigeration units 10 of the refrigerating system, the storage devices 15 of which have a minimum discharge state, can bring the temperature of the coolant in the supply network substantially to a defined temperature so that at least one further refrigeration unit 10 of the refrigerating system is appropriately cooled and/or the storage device 15 thereof discharged.

Figure 2:
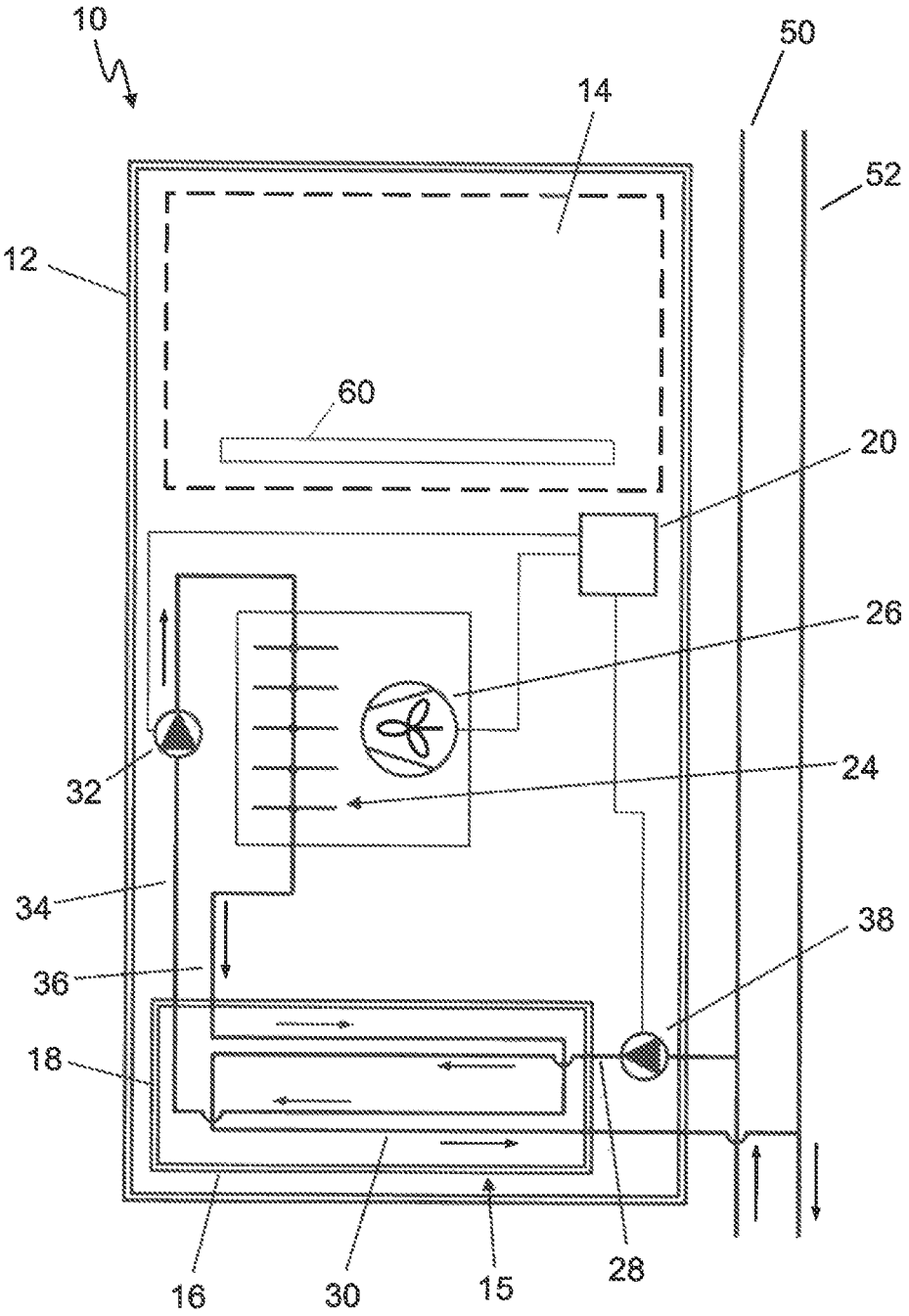
FIG. 2 shows a further schematic illustration of a refrigeration unit.

FIG. 2 shows a further, schematic illustration of the refrigeration unit 10, in which case the coolant regulating device 22 is constructed as a speed-regulated pump 38 and arranged in the forward run 28, instead of a pump 38, it is also possible in other embodiments (not illustrated) for valves to be provided.

Moreover, the refrigeration units 10 shown in FIGS. 1 to 4 comprise further components such as valves, insulations, assembly and connecting elements and control components, which are not illustrated.

Figure 3:
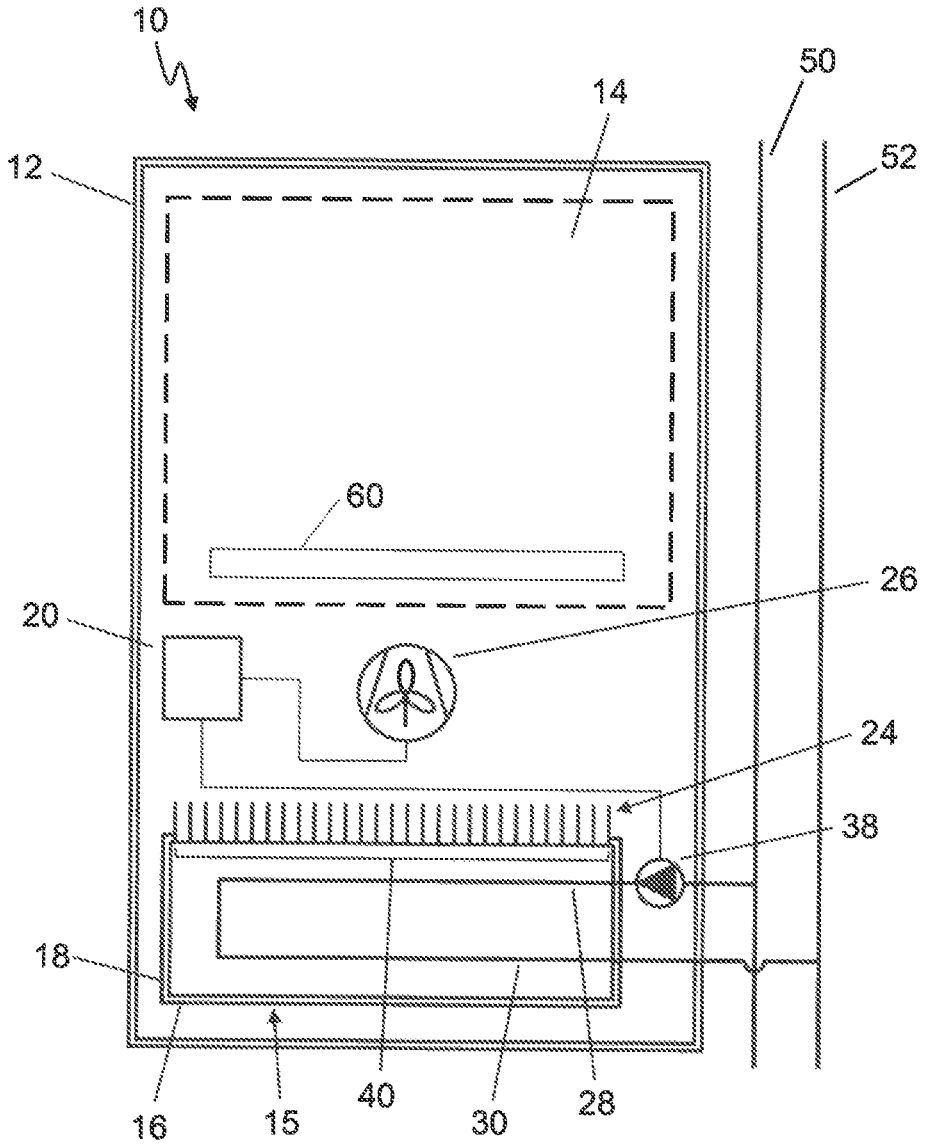
FIG. 3 snows yet a further schematic illustration of a refrigeration unit.

FIG. 3 shows yet a further, schematic illustration of refrigeration unit 10 with a heat exchanger 24 connected directly with the storage device 15. The housing 16 of the storage device 15 consists of a thermally conductive material and comprises an insulation 18 which insulates the storage device 15 apart from a section 40 by way of which the storage device 15 is connected with the heat exchanger 24. In addition, it is also possible for only the section 40 to consist of a thermally conductive material. The rest of the housing 16 can consist of different materials which have, for example, thermally insulating characteristics. In the case of the refrigeration unit 10 of FIG. 3, cooling or discharging of the storage device 15 equally takes place by way of a coolant fed by way of the forward run 50 of a coolant supply network.

The feed of coolant by way of the supply network is carried out via the pump 32. The controller 20 of the refrigeration unit 10 regulates the amount of coolant, which is conducted from the coolant supply network into the storage device 15 in order to discharge the storage device 15, by way of the rotational speed of the pump 32. In particular, in the case of a relatively low coolant temperature a rapid discharge of the storage device 15 can be achieved by a high rotational speed. Moreover, it is also possible to throttle the rotational speed of the pump 32 in order to provide a lower rate of coolant feed, which leads to slower discharging. Equally, a lower rotational speed of the pump 32 can be set by way of the controller 20 when the coolant has a temperature which is too low. It is thereby ensured that defined discharging of the storage device 15 takes place. It is to be noted, in particular, that in the storage device 15 a discharge, for example a phase conversion of the storage medium from liquid to solid, takes place from the inside to the outside. In order to prevent direct coupling of the heat exchanger 24 with the coolant conducted in the first coolant line arrangement the forward run 28 and return run 30 are, in particular, arranged at a spacing from the heat exchanger 24.

In the case of a conventional cooling system for refrigerated shelves of the prior art with a product room temperature of 4° C. then, for example, a coolant is provided from a central supply line. This coolant has a temperature of −2° C. Due to the low temperature of the coolant relatively strong icing of the heat exchanger can therefore occur in a short time. In the case of the refrigerating systems described herein there is no feed of coolant from a central supply line to the heat exchangers 24. Coolant of a second coolant circuit in the refrigeration unit, which is coupled with a storage device 15, is fed to the heat exchangers 24, or the heat exchangers 24 are cooled directly by way of a storage device 15. The heat exchangers 24 in the case of refrigerated shelving 60 with a product room temperature of 4° C. thus have no regions which are cooled to an excessive extent. For that purpose, the coolant of a second coolant circuit can have a temperature of, tier example, 2° C. in the forward run.

In the case of refrigerating systems of the prior art very low forward run temperatures of the coolant are accordingly set, since the coolant has to be supplied over, in part, lengthy routes to remote refrigerated shelves as well and the coolant temperature increases along the route. In order to ensure, for example, a coolant temperature of 0° C. at a remote refrigerated shelf of a refrigerating system of the prior art the coolant temperature at a first refrigerated shelf had to be −4° C. These relatively large temperature differences have led to remote refrigeration units being less strongly cooled. This can also have the consequence that heat exchangers of refrigerated shelves which do not have a large spacing from a cold generator strongly ice up in a relatively short time. The variants described herein do not have these problems, since the heat exchangers 24 are not directly coupled with the coolant of the supply network. In addition, in the case of very low coolant temperatures in the coolant supply network, cooling of several refrigeration units 10 with the same temperature can take place. Moreover, icing, for example of the storage medium in the storage device container, offers the possibility of cooling the refrigerating space 14 over a lengthy period time without coolant having to be supplied from outside.

In addition, in the case of the embodiment according to FIG. 3 a homogenous cooling of the heat exchanger 24 over the entire length thereof and, in particular, over the entire contact area thereof is achieved by the thermally conductive housing 16 of the storage device 15.

Figure 4:
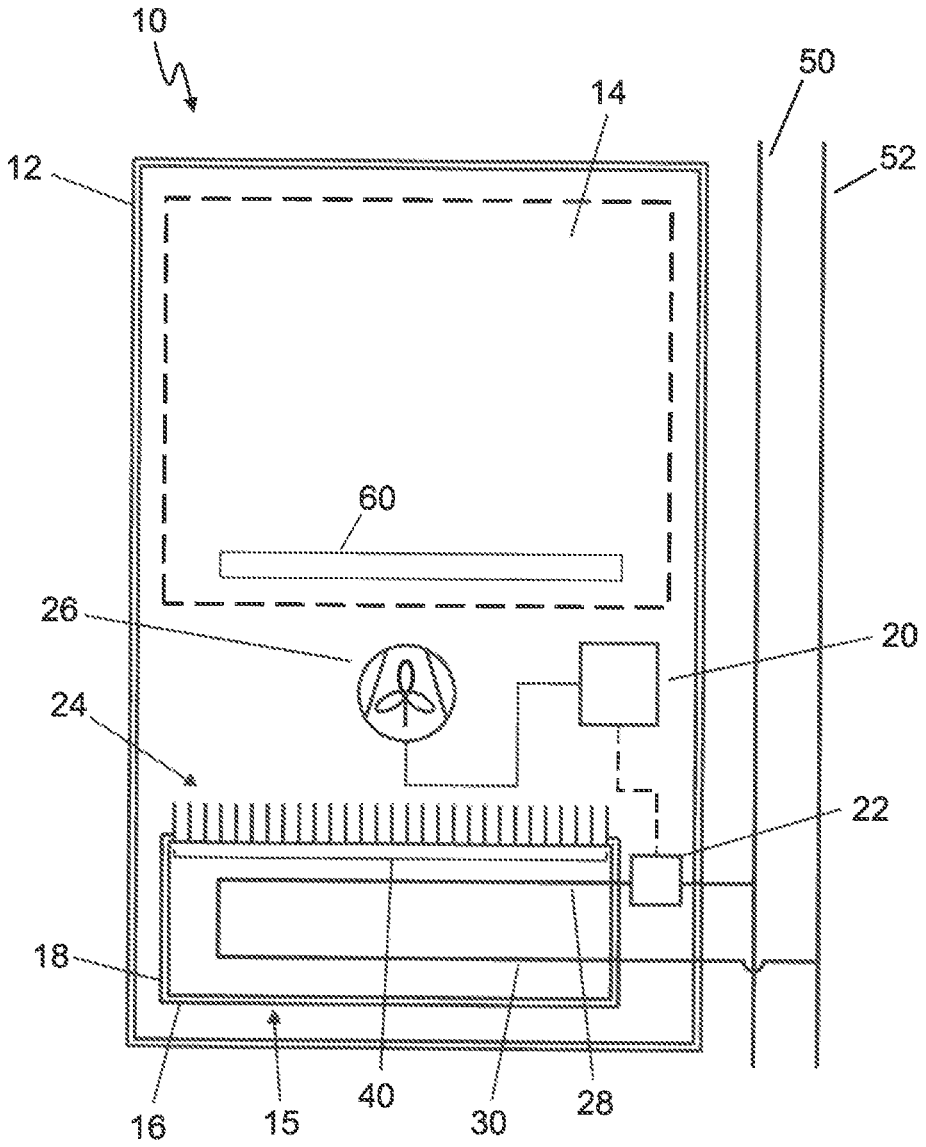
FIG. 4 shows a still further schematic illustration of a refrigeration unit.

FIG. 4 shows yet a further schematic illustration of a refrigeration unit 10, wherein the embodiment of FIG. 4 differs from the embodiment of FIG. 3 in that in general a coolant regulating device 22 is arranged in the forward run 28 instead of a speed-regulated pump 32. The coolant regulating device 22 can be, for example, a valve.

Figure 5:
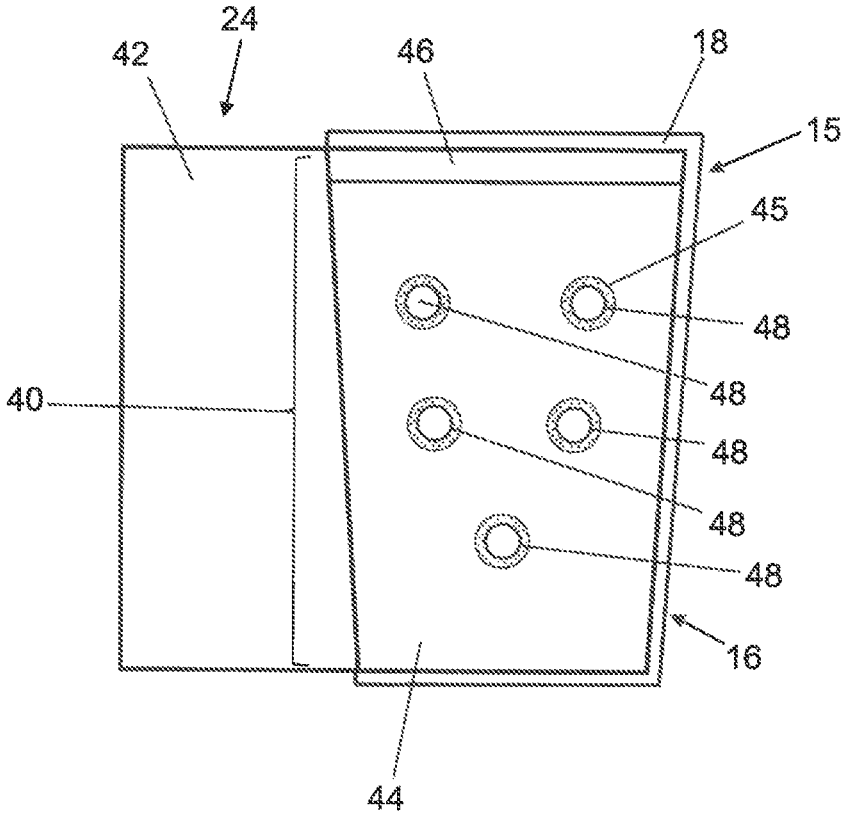
FIG. 5 shows a schematic illustration of a storage device with a directly coupled heat exchanger.

FIG. 5 shows a schematic illustration of a storage device 15 with a heat exchanger 24 coupled therewith. The housing 16 has a form which is wider in upward direction. The receiving space for the storage medium 44 is not completely filled with a storage medium 44, 45, but has a compensating region 46. The compensating region 46 serves for reception of the storage medium 44, 45 after expansion due to a phase change. The trapezium-shaped form of the storage device 15 in cross-section equally serves for defined expansion of the storage medium 44, 45 after a phase conversion.

FIG. 5 shows a schematic sectional view of the storage device 15 and the heat exchanger 24. The storage device 15 can similarly have trapezium-shaped side walls in longitudinal direction.

The heat exchanger 24 is arranged at the lefthand side of the housing 16 over a section 40. The heat exchanger 24 consists of a thermally conductive material, preferably the same thermally conductive material as the housing 16 of the storage device 15 or the section 40 of the housing 16. In further forms of embodiment, the heat exchanger 24 can also be constructed directly at the housing 16 of the storage device 15 and produced integrally therewith. In still further forms of embodiment a surface of the heat exchanger 24 forms a side wall of the housing 16 of the storage device 15. The remaining parts of the housing 16 can then be made of other materials and connected with the section 40. In addition, the storage device 15 comprises an insulation 18. The insulation 18 completely surrounds the storage device 15 apart from the section 40, so that there is substantially no heat transfer between the storage device 15 and the space surrounding it. The insulation 18 can be formed by, for example, foam materials.

Moreover, the insulation 18 can consist of a layer composite of several layers of different materials.

Coolant lines 48 of the forward run 28 and return run 30 of the first coolant line arrangement and/or coolant lines 48 of the forward run 34 and return run 36 of the second coolant line arrangement are accommodated in the interior of the storage device 15. Flowing through the coolant lines 48 is, for example, the coolant provided by way of a coolant supply network.

The illustration of FIG. 5 is schematic. The coolant lines 48 can therefore also be lines of the forward run 34 and return run 36 of the second coolant line arrangement. Equally, the number of coolant lines 48 is merely exemplifying. The coolant lines 48 are preferably laid in the housing 16 in such a way that they are not in direct contact with the side walls of the storage device 15. The arrangement of the coolant lines 48 is, in particular, selected so that a defined discharge of the storage device 15 by coolant feed from the coolant supply network takes place from the inside to the outside and thawing takes place through supply of heat via a further coolant or via the heat exchanger 24 directly from the outside to the inside.

The discharge from the inside to the outside is illustrated schematically in FIG. 4 by the frozen sections of the storage medium 45. In that case, the storage medium 45 freezes firstly at the coolant lines 48, which have a homogenous thermal conductivity at least in the sections in which they are guided within the storage device 15.

The housing 16 of the storage device 15 has additional connections for the coolant lines 48. In further forms of embodiment, the storage device container or a storage device container together with a heat exchanger 24 is a subassembly able to be subsequently installed in a refrigeration unit 10. This means that coolant lines 48 are already arranged within the storage device 15 and a storage medium 44 is provided in the storage device 15. Coupling to a forward run 28 and a return run 30 of a first coolant line arrangement can then be undertaken by way of appropriately defined connections. In addition, coupling with a second coolant line arrangement can be effected by way of further, optionally provided connections for a forward run 34 and return run 36.

It is thereby possible, in particular, to interrupt a coolant circuit of an existing refrigeration unit and arrange the storage device 15. The storage device 15 then provides a separation for an internal circuit of the refrigeration unit from an external circuit of a coolant supply network. However, there is additionally a thermal coupling of the two coolant circuits and a storage of 'coldness' is provided. Filling of the coolant circuits, particularly of a thus-formed internal coolant circuit for the refrigeration unit, can be undertaken subsequently.

REFERENCE NUMERAL LIST

10 refrigeration unit
12 housing
14 refrigerating space
15 storage device
16 housing
18 insulation
20 controller
22 coolant regulating device
24 heat exchanger
26 fan
28 forward run
30 return run
32 pump
34 forward run
36 return run
38 pump
40 section
42 cooling rib
44 storage medium
45 storage medium
46 compensating region
48 coolant line
50 forward run
52 return run
60 refrigerated shelving

The invention claimed is:

1. A refrigeration unit comprising a refrigerating space for reception and storage of items to be refrigerated, a storage device for storing a storage medium with a storage device container in which a storage medium is received, a heat exchanger, a controller and a coolant line arrangement connectible by connections with a coolant supply network, wherein the coolant line arrangement is led through the storage device container, the heat exchanger is arranged at an outside of the storage device and is thermally coupled with the storage medium received in the storage device container, a coolant regulating device, which regulates a feed of a coolant from the coolant supply network to the storage device, is arranged in a forward run of the coolant line arrangement, the coolant regulating device is a speed-regulated pump, the storage device container at least in a section comprises a thermally conductive material and has an insulation, the insulation completely surrounds the storage device apart from a section by which the storage device is connected with the heat exchanger, and the heat exchanger has cooling ribs, wherein the heat exchanger is coupled by at least one thermally conductive section of the storage device container with the storage medium received in the storage device container, and wherein a second coolant line arrangement is led through the storage device container and connected with the heat exchanger.

2. The refrigeration unit according to claim 1, wherein a speed-regulated pump is arranged in a forward run of the second coolant line arrangement.

3. The refrigeration unit according to claim 2, further comprising at least one speed-regulated fan.

4. The refrigeration unit according to claim 2, wherein the refrigeration unit has refrigerated shelving.

5. The refrigeration unit according to claim 1, further comprising at least one speed-regulated fan.

6. The refrigeration unit according to claim 2, wherein the refrigeration unit has refrigerated shelving.

7. The refrigeration unit according to claim 1, wherein the refrigeration unit has refrigerated shelving.

8. A refrigeration system comprising at least one refrigeration unit as claimed in claim 1 and a cold generator, wherein a coolant is fed by a central coolant line arrangement to the at least one refrigeration unit via a forward run and is conducted away via a return run and the cold generator brings the coolant to a settable temperature, wherein the feed of coolant for discharge of the storage device is regulated by the controller of the refrigeration unit via the coolant regulating device in the forward run of the coolant line arrangement and/or the circulation of air over at least one heat exchanger for cooling the refrigerating space is regulated by the controller of the refrigeration unit via an at least one fan and/or the feed of coolant to at least one heat exchanger is regulated by the controller of the refrigeration unit in dependence on a charge state of the storage device and/or an operating state of the cold generator via the speed-regulated pump in a forward run of a second coolant line arrangement.

9. A method of controlling a refrigeration unit as claimed in claim 1, said refrigeration unit comprising a refrigerating space for reception and storage of items to be refrigerated, a storage device for storing a storage medium with a storage device container in which a storage medium is received, a heat exchanger, a controller and a first coolant line arrangement which is connectible with a coolant supply network by connections, wherein the first coolant line arrangement is led through the storage device container, the heat exchanger is thermally coupled with the storage medium received in the storage device container and a coolant regulating device which regulates a feed of a coolant from the coolant supply network to the storage device, is arranged in a forward run of the first coolant line arrangement and wherein the storage medium received in the storage device container is cooled by a coolant in the first coolant line arrangement and the heat exchanger is cooled by the storage medium.

10. The method according to claim 9, wherein a second coolant line arrangement is led through the storage device container and connected with the heat exchanger and a speed-regulated pump is arranged in a forward run of the second coolant line arrangement, wherein discharge of the storage device is carried out by the coolant regulating device in the forward run of the first coolant line arrangement and/or thawing of the storage device and feed of coolant to at least one heat exchanger are carried out by the speed-regulated pump in the forward run of the second coolant line arrangement and/or circulation of air for cooling the refrigerating space is carried out by at least one speed-regulated fan.

* * * * *